US010162284B2

(12) United States Patent
Kuramoto et al.

(10) Patent No.: US 10,162,284 B2
(45) Date of Patent: Dec. 25, 2018

(54) DEVELOPING DEVICE AND IMAGE FORMING APPARATUS

(71) Applicant: FUJI XEROX CO., LTD., Tokyo (JP)

(72) Inventors: Shinichi Kuramoto, Kanagawa (JP); Yoshitaka Nakajima, Kanagawa (JP); Ayumi Noguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/786,569

(22) Filed: Oct. 17, 2017

(65) Prior Publication Data

US 2018/0267427 A1 Sep. 20, 2018

(30) Foreign Application Priority Data

Mar. 15, 2017 (JP) ..... 2017-049640

(51) Int. Cl.
*G03G 15/08* (2006.01)

(52) U.S. Cl.
CPC ..... *G03G 15/0822* (2013.01); *G03G 15/0808* (2013.01); *G03G 15/0812* (2013.01)

(58) Field of Classification Search
CPC ..... G03G 9/08755; G03G 9/08797; G03G 9/08795; G03G 9/0821; G03G 9/0819
USPC ..... 399/252
See application file for complete search history.

(56) References Cited

U.S. PATENT DOCUMENTS 5,467,174 A * 11/1995 Koga ..... G03G 9/0819 399/176
5,546,171 A * 8/1996 Hayashi ..... G03G 15/167 399/297

FOREIGN PATENT DOCUMENTS

| | | |
|---|---|---|
| JP | 2005-346035 | 12/2005 |
| JP | 2008-039965 | 2/2008 |
| JP | 4695542 | 6/2011 |

OTHER PUBLICATIONS

Translation of Hattori (JP 2007-148335 A) listed in the IDS, publication date: Jun. 14, 2007.*
Translation of Masui (JP 04191769 A) listed in the IDS, publication date: Jul. 10, 1992.*

* cited by examiner

*Primary Examiner* — Walter L Lindsay, Jr.
*Assistant Examiner* — Frederick Wenderoth
(74) *Attorney, Agent, or Firm* — JCIPRNET

(57) ABSTRACT

A developing device includes a container that contains developer; a rotating body that rotates while carrying the developer and supplies the developer to a latent image formed on an image carrier; a channel through which air in the container is discharged out of the container; a first member that is positioned downstream of a position at which the developer is separated from the rotating body in a rotation direction of the rotating body and with which the developer separated from the rotating body comes into contact; and a second member that is positioned downstream of the first member in the rotation direction of the rotating body and with which the developer separated from the rotating body comes into contact.

20 Claims, 8 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2017-049640 filed Mar. 15, 2017.

BACKGROUND

Technical Field

The present invention relates to a developing device and an image forming apparatus.

SUMMARY

According to an aspect of the invention, there is provided a developing device including a container that contains developer; a rotating body that rotates while carrying the developer and supplies the developer to a latent image formed on an image carrier; a channel through which air in the container is discharged out of the container; a first member that is positioned downstream of a position at which the developer is separated from the rotating body in a rotation direction of the rotating body and with which the developer separated from the rotating body comes into contact; and a second member that is positioned downstream of the first member in the rotation direction of the rotating body and with which the developer separated from the rotating body comes into contact.

BRIEF DESCRIPTION OF THE DRAWINGS

An Exemplary embodiment of the present invention will be described in detail based on the following figures, wherein.

DETAILED DESCRIPTION

Exemplary Embodiment

Figure 1:
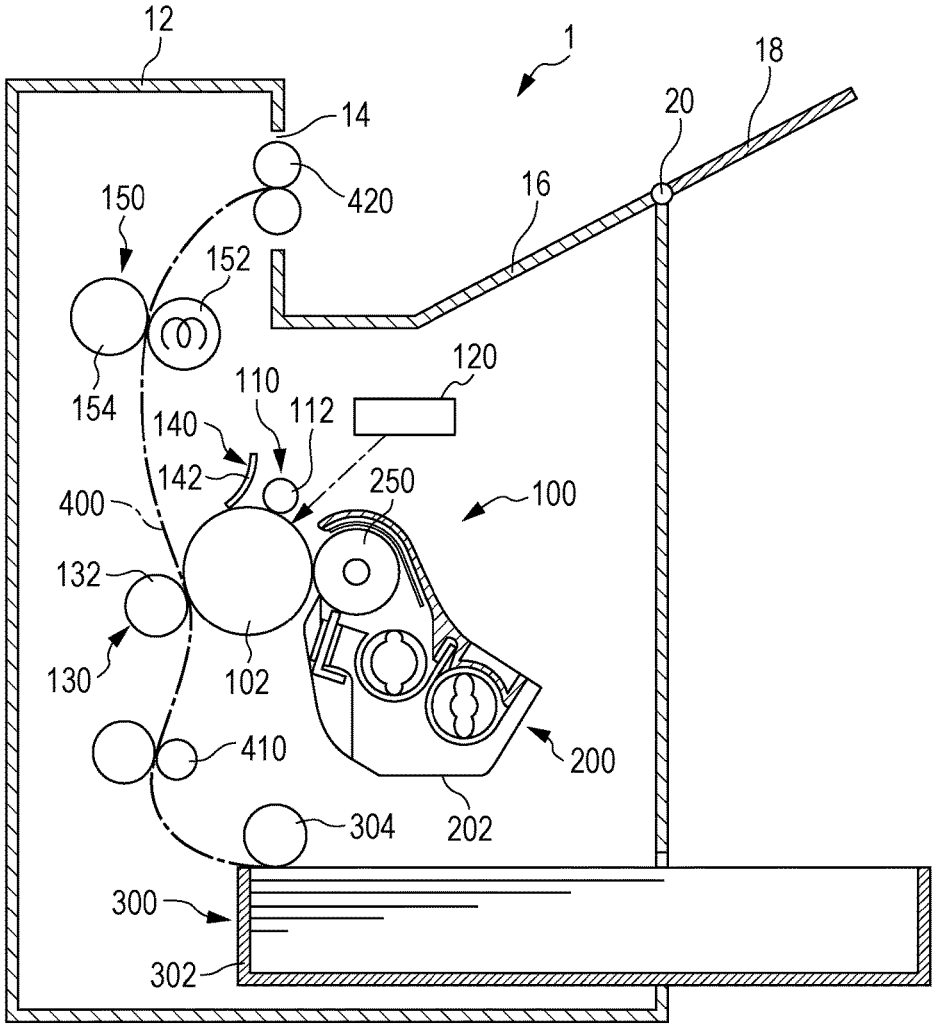
FIG. 1 is a schematic diagram illustrating the internal structure of an image forming apparatus according to an exemplary embodiment of the present invention.

FIG. 1 is a schematic diagram illustrating the internal structure of an image forming apparatus 1 according to an exemplary embodiment of the present invention. As illustrated in FIG. 1, the image forming apparatus 1 includes an image forming unit 100 disposed in a housing 12. The image forming apparatus 1 also includes a transport path 400 along which paper sheets used as image recording media are transported, and a feeding device 300 that feeds the paper sheets to the transport path 400.

The housing 12 has a discharge port 14 through which the paper sheets are discharged out of the housing 12. A stacking portion 16, on which the paper sheets discharged through the discharge port 14 are stacked, and a support plate 18 are disposed near the discharge port 14. The support plate 18, which also receive the paper sheets discharged through the discharge port 14, is capable of being rotated around a hinge 20 so as to be folded onto the stacking portion 16.

The image forming unit 100 forms an image on a paper sheet by an electrophotographic method while the paper sheet is being transported along the transport path 400. The image forming unit 100 includes a photoconductor 102, which has a solid cylindrical shape and which is an example of an image carrier that carries an image to be formed on the paper sheet; a charging device 110 that charges the photoconductor 102; an exposure device 120 that forms an electrostatic latent image on the surface of the photoconductor 102 by irradiating the charged surface of the photoconductor 102 with light; a developing device 200 that forms an image (toner image) on the surface of the photoconductor 102 with toner by developing the electrostatic latent image with developer containing the toner; a transfer device 130 that transfers the toner image formed on the surface of the photoconductor 102 onto the paper sheet; a cleaning device 140 that cleans the photoconductor 102 after the toner image is transferred onto the paper sheet; and a fixing device 150 that fixes the toner image that has been transferred onto the paper sheet to the paper sheet.

The charging device 110 includes a charging member 112 that charges the photoconductor 102. The charging member 112 is a solid cylindrical member that is in contact with or close to the photoconductor 102. A direct-current voltage or a voltage obtained by superposing an alternating-current voltage on a direct-current voltage is applied to the charging member 112, and the photoconductor 102 is charged by the effect of the applied voltage.

The developing device 200 contains the developer obtained by mixing the toner with carrier, and develops the electrostatic latent image by using the developer contained therein. The developer contained in the developing device 200 is obtained by, for example, mixing non-magnetic toner charged to a negative polarity with magnetic carrier charged to a positive polarity. The developing device 200 includes a container 202, which serves as a housing and contains the developer, and a supplying mechanism 250, which supplies the toner contained in the developer in the container 202 to the photoconductor 102.

The transfer device 130 includes a solid cylindrical transfer member 132. The transfer member 132 is arranged so as to face the photoconductor 102 so that a transport path 400 is interposed between the transfer member 132 and the photoconductor 102. The transfer member 132 receives a voltage for transferring the image formed on the photoconductor 102 onto the paper sheet.

The cleaning device 140 includes a plate-shaped cleaning member 142. An end portion of the cleaning member 142 is in contact with the photoconductor 102. The toner that remains on the surface of the photoconductor 102 after the image has been transferred onto the paper sheet is removed by the end portion of the cleaning member 142 that is in contact with the photoconductor 102.

The fixing device 150 includes a hollow cylindrical heating roller 152 having a heat source disposed therein and a solid cylindrical pressing roller 154 that faces the heating roller 152 with the transport path 400 interposed therebetween. The fixing device 150 fixes the toner image formed on the paper sheet to the paper sheet by heating the paper sheet with the heating roller 152 and pressing the paper sheet with the pressing roller 154 while the paper sheet is being transported along the transport path 400.

The feeding device 300 includes a container unit 302 and a transport roller 304. The container unit 302 contains paper sheets to be fed to the transport path 400. The transport roller 304 feeds the paper sheets contained in the container unit 302 to the transport path 400.

The transport path 400 extends from the feeding device 300 to the discharge port 14 through the space between the transfer device 130 and the photoconductor 102 and through the fixing device 150. A solid cylindrical transport roller 304, a solid cylindrical registration roller 410, and a solid cylindrical discharge roller 420 are arranged near the transport path 400. The registration roller 410 rotates to transport each paper sheet to the space between the photoconductor 102 and the transfer member 132. The registration roller 410 rotates at a controlled timing so that the image on the photoconductor 102 is transferred onto the paper sheet. The discharge roller 420 rotates to discharge the paper sheet to which the image has been fixed by the fixing device 150 to the outside of the housing 12.

Figure 2:
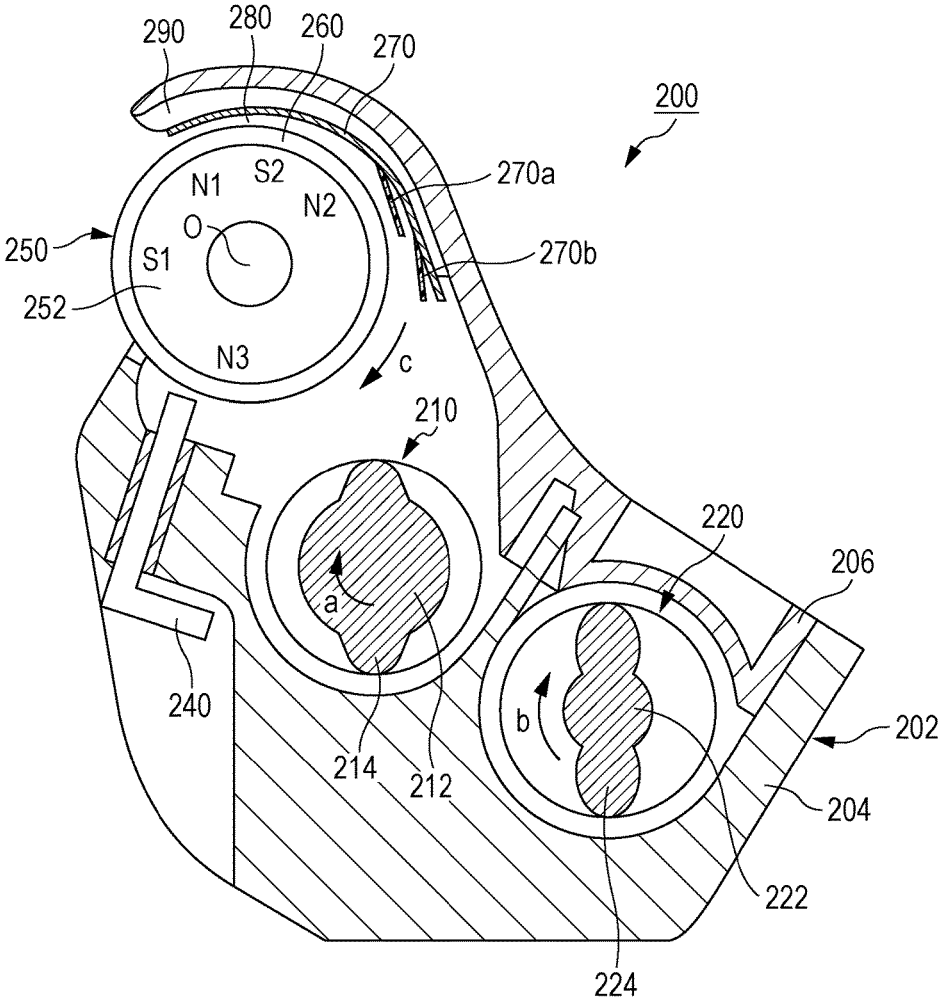
FIG. 2 is a schematic diagram illustrating the internal structure of a developing device.

FIG. 2 is a schematic diagram illustrating the internal structure of the developing device 200. The developing device 200 includes the container 202 that serves as the housing of the developing device 200 and that contains the developer, a first transport member 210, a second transport member 220, a regulating member 240, the supplying mechanism 250, a channel defining member 270, a first member 270*a*, and a second member 270*b*.

The container 202, which is an example of a container according to an exemplary embodiment of the present invention, includes a container lower portion 204, which is a lower portion of the container 202, and a container upper portion 206, which is an upper portion of the container 202 and which is attached to the container lower portion 204. The container 202 has a space provided therein. The container upper portion 206 has an opening (not shown) that connects the outside of the developing device 200 to the inside of the developing device 200. The toner is supplied into the container 202 from a toner container (not shown), which contains the toner, through the opening.

The second transport member 220 stirs the developer supplied from the toner container in the container 202, and transports the developer. The second transport member 220 includes a shaft portion 222 and a blade portion 224 that is helically formed around the outer peripheral surface of the shaft portion 222. The shaft portion 222 and the blade portion 224 rotate together in the direction of arrow b in FIG. 2. When the second transport member 220 rotates, the blade portion 224 stirs the developer and transports the developer in the longitudinal direction of the second transport member 220 (direction perpendicular to the plane of FIG. 2). The developer that has been transported to one end of the second transport member 220 in the longitudinal direction is transported to the first transport member 210.

The first transport member 210 stirs the developer that has been transported from the second transport member 220 and the developer that has been separated from a developing sleeve 260 in the container 202, and transports the developer to the supplying mechanism 250. The first transport member 210 includes a shaft portion 212 and a blade portion 214 that is helically formed around the outer peripheral surface of the shaft portion 212. The shaft portion 212 and the blade portion 214 rotate together in the direction of arrow a in FIG. 2. When the first transport member 210 rotates, the blade portion 214 stirs the developer. In addition, when the first transport member 210 rotates, the developer is transported in the longitudinal direction of the first transport member 210 (direction perpendicular to the plane of FIG. 2) and is also transported toward the supplying mechanism 250 (leftward in FIG. 2).

When the developer is transported while being stirred by the second transport member 220 and the first transport member 210 in the container 202, the toner contained in the developer is charged by friction with the carrier by being agitated together with the carrier.

The supplying mechanism 250 includes a solid cylindrical magnet member 252 having plural magnetic poles and the developing sleeve 260, which has a hollow cylindrical shape and accommodates the magnet member 252.

The developing sleeve 260, which is an example of a rotating body according to an exemplary embodiment of the present invention, is made of a non-magnetic material. The developing sleeve 260 is connected to, for example, a driving mechanism (not shown) including a motor and a gear for rotating the developing sleeve 260, and is rotated in the direction of arrow c in FIG. 2 in response to rotation of the motor. The developing sleeve 260 rotates while carrying the developer on the surface thereof, and supplies the toner contained in the developer to the photoconductor 102, which faces the developing sleeve 260.

The magnetic poles of the magnet member 252 each have a solid cylindrical shape and extend in an axial direction. For example, the magnet member 252 includes a magnetic pole N1, a magnetic pole N2, a magnetic pole N3, a magnetic pole S1, and a magnetic pole S2. The magnetic poles N1, N2, and N3 have the same polarity. The magnetic poles S1 and S2 have the same polarity. The polarity of the magnetic poles S1 and S2 differs from that of the magnetic poles N1 to N3.

The magnetic pole N3 is provided to retain the developer that has been transported to a region near the developing sleeve 260 on the surface of the developing sleeve 260. An end portion of the regulating member 240, which will be described below, is positioned so as to face the magnetic pole N3 with the developing sleeve 260 provided therebetween in a region of influence of the magnetic force of the magnetic pole N3. Part of the developer retained on the developing sleeve 260 by the magnetic power of the magnetic pole N3 is not able to pass through the gap between the developing sleeve 260 and the regulating member 240, and is removed from the surface of the developing sleeve 260 by the regulating member 240. Thus, the thickness of the developer on the developing sleeve 260 is regulated.

The magnetic pole S1 is disposed downstream of the magnetic pole N3 in the rotation direction of the developing sleeve 260 so as to face the photoconductor 102. The magnetic pole S1 is provided to develop the electrostatic latent image on the surface of the photoconductor 102 by using the toner transported by the developing sleeve 260.

The magnetic pole N1 is disposed downstream of the magnetic pole S1 in the rotation direction of the developing sleeve 260. The magnetic pole N1 is provided to retain the developer that has not been supplied to the photoconductor 102 and that has remained on the developing sleeve 260 on the surface of the developing sleeve 260.

The magnetic pole S2 is disposed downstream of the magnetic pole N1 in the rotation direction of the developing sleeve 260. The magnetic pole S2 is used to transport the developer, and retains the developer on the developing sleeve 260 after the developer has been transported downstream in the rotation direction of the developing sleeve 260 from the position of the magnetic pole N1 by the rotation of the developing sleeve 260.

The magnetic pole N2 is disposed downstream of the magnetic pole S2 in the rotation direction of the developing sleeve 260. The magnetic pole N2 is provided to separate the developer that has been transported by the developing sleeve 260 from the developing sleeve 260. Since the magnetic poles N2 and N3 have the same polarity, the magnetic poles N2 and N3 form a repulsive magnetic field, and the developer retained by the developing sleeve 260 becomes separated from the developing sleeve 260 at a position downstream of the magnetic pole N2 in the rotation direction.

The regulating member 240 regulates the layer thickness of the developer retained on the surface of the developing sleeve 260. The regulating member 240 is attached to the container 202 so that a predetermined gap is provided between the end portion of the regulating member 240 that opposes the developing sleeve 260 and the developing sleeve 260.

The channel defining member 270 is positioned between the developing sleeve 260 and the container upper portion 206 so as to define a first channel 280 between the channel defining member 270 and the developing sleeve 260 and a second channel 290 between the channel defining member 270 and the container upper portion 206.

Figure 3:
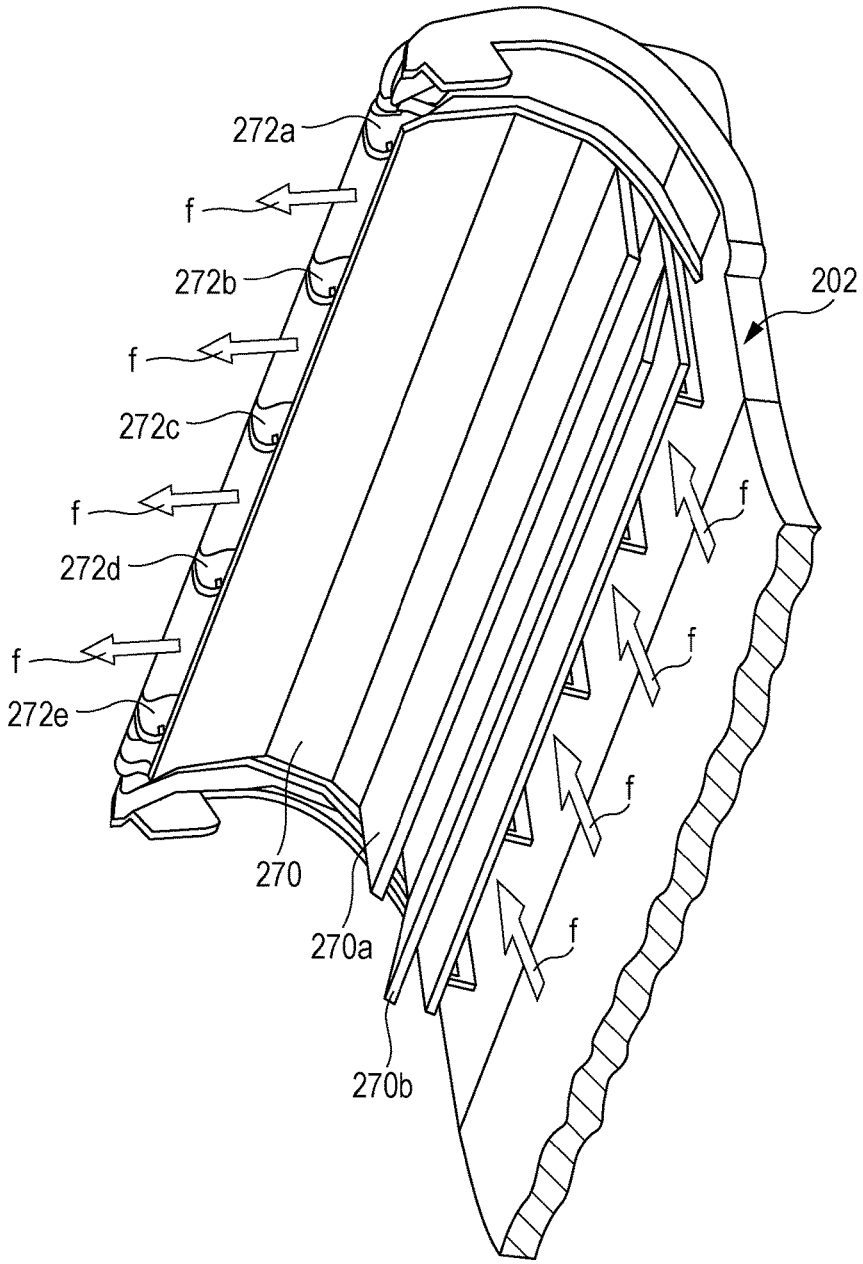
FIG. 3 illustrates the positional relationship between a channel defining member and a container upper portion.

FIG. 3 illustrates the positional relationship between the channel defining member 270 and the container upper portion 206. The channel defining member 270 faces the container upper portion 206, and includes a support portion 272*a*, a support portion 272*b*, a support portion 272*c*, a support portion 272*d*, and a support portion 272*e* that project toward the container upper portion 206. The support portions 272*a* to 272*e* are fixed to the inner surface of the container upper portion 206 so that the second channel 290 is defined between the container upper portion 206 and the channel defining member 270 and that the first channel 280 is defined between the channel defining member 270 and the developing sleeve 260.

Figure 4:
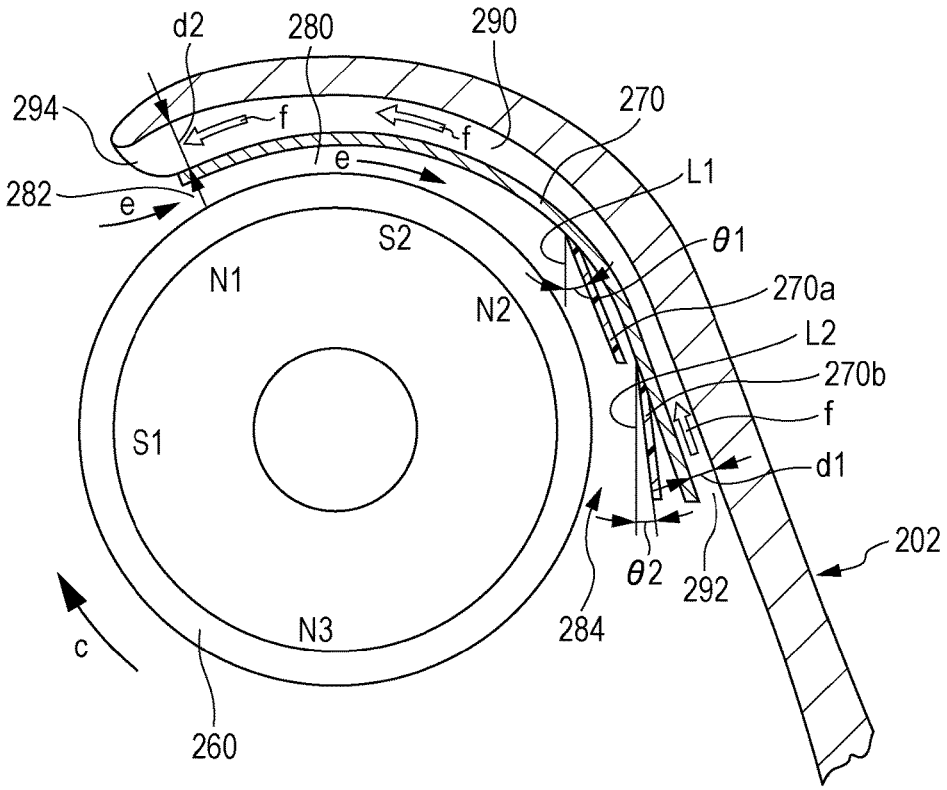
FIG. 4 is an enlarged view of the region around the channel defining member.

FIG. 4 is an enlarged view of the region around the channel defining member 270. In the developing device 200, the first channel 280 is disposed downstream of the region in which the developing sleeve 260 supplies the toner to the photoconductor 102 in the rotation direction of the developing sleeve 260. The first channel 280 has a first inlet 282 that is disposed downstream of the region in which the developing sleeve 260 supplies the toner to the photoconductor 102 in the rotation direction of the developing sleeve 260, and a first outlet 284 that is disposed behind the developing sleeve 260 when viewed from the photoconductor 102. When the developing sleeve 260 rotates in the direction of arrow c, air around the first inlet 282 flows into the first channel 280, as indicated by arrows e in FIG. 4. The air that has flowed into the first channel 280 flows into the container 202 through the first outlet 284. The first channel 280 is an example of a channel through which air outside the container 202 flows into the container 202 according to an exemplary embodiment of the present invention.

When the air flows into the container 202 as described above, the pressure in the container 202 increases. The pressure increases by a larger amount as the rotational speed of the developing sleeve 260 increases in response to an increase in the image forming speed of the image forming apparatus 1. The developing device 200 according to the present exemplary embodiment has the second channel 290 to reduce the pressure increase in the container 202. The second channel 290 is an example of a channel through which air in the container 202 is discharged out of the container 202 according to an exemplary embodiment of the present invention.

The second channel 290 is a space that connects the space inside the container 202 to the space outside the container 202. The second channel 290 has a second inlet 292 that is disposed behind the first outlet 284 when viewed from the photoconductor 102, and a second outlet 294 that is disposed above the first inlet 282. In other words, the second inlet 292 is adjacent to the first outlet 284 with an end portion of the channel defining member 270 disposed therebetween, and the second outlet 294 is adjacent to the first inlet 282 with an end portion of the channel defining member 270 disposed therebetween. The distance d2 from the channel defining member 270 to the container upper portion 206 at a position near the second outlet 294 is greater than the distance d1 from the channel defining member 270 to the container upper portion 206 at a position near the second inlet 292.

Since the second channel 290 connects the space inside the container 202 to the space outside the container 202, the high-pressure air in the container 202 flows into the second channel 290 through the second inlet 292. The air that has flowed into the second channel 290 flows in the direction indicated by arrows f, and is discharged through the second outlet 294 at which the pressure is lower than that in the container 202. Since the air in the container 202 is discharged out of the container 202, the pressure increase in the container 202 is reduced. In addition, in the second channel 290, the distance from the channel defining member 270 to the container upper portion 206 increases with increasing distance from the second inlet 292 toward the second outlet 294. Therefore, the pressure in the second channel 290 decreases with increasing distance from the second inlet 292 toward the second outlet 294.

The first member 270*a* is an example of a first member according to an exemplary embodiment of the present invention. In the present exemplary embodiment, the first member 270*a* is a plate-shaped member made of a synthetic resin. The first member 270*a* is disposed behind the magnetic pole N2 when viewed from the photoconductor 102, and projects from a surface of the channel defining member 270 that faces the developing sleeve 260. At least a portion of the first member 270*a* is positioned below the top end of the magnetic pole N2. The second member 270*b* is an example of a second member according to an exemplary embodiment of the present invention. In the present exemplary embodiment, the second member 270*b* is a plate-shaped member made of a synthetic resin. The second member 270*b* is disposed behind the magnetic pole N2 and behind the first member 270*a* when viewed from the photoconductor 102, and projects from the surface of the channel defining member 270 that faces the developing sleeve 260. In other words, the second member 270*b* is positioned between the position at which the developer is separated from the developing sleeve 260 and the second inlet 292, and the first member 270*a* is positioned between the position at which the developer is separated from the developing sleeve 260 and the second member 270*b*.

The angle between the first member 270*a* and a vertical line L1 that extends from the end of the first member 270*a* on the channel defining member 270 is denoted by θ1. Referring to FIG. 4, when it is assumed that the angle is positive if the first member 270*a* is on the right side of the vertical line L1 and negative if the first member 270*a* is on the left side of the vertical line L1, the angle θ1 is positive in the present exemplary embodiment. In other words, the first member 270*a* is inclined rearward relative to the vertical line L1 when viewed from the developing sleeve 260.

The angle between the second member 270*b* and a vertical line L2 that extends from the end of the second member 270*b* on the channel defining member 270 is denoted by θ2. Referring to FIG. 4, when it is assumed that the angle is positive if the second member 270*b* is on the right side of the vertical line L2 and negative if the second member 270*b* is on the left side of the vertical line L2, the angle θ2 is positive in the present exemplary embodiment. In other words, the second member 270*b* is inclined rearward relative to the vertical line L2 when viewed from the developing sleeve 260. The angle θ1 and the angle θ2 satisfy the relationship θ1>θ2.

When the developer retained by the developing sleeve 260 that rotates in the direction of arrow c reaches a position downstream of the magnetic pole N2 in the rotation direction of the developing sleeve 260, the developer retained by the developing sleeve 260 becomes separated from the developing sleeve 260. The developer separated from the developing sleeve 260 flows rearward beyond the developing sleeve 260 when viewed from the photoconductor 102. Part of the developer comes into contact with the first member 270*a*, and another part of the developer comes into contact with the second member 270*b*.

Part of the developer that has come into contact with the first member 270*a* is decelerated due to the contact, and falls downward. Another part of the developer that has come into contact with the first member 270*a* comes into contact with the second member 270*b*, which is behind the first member 270*a* when viewed from the photoconductor 102. The developer that has come into contact with the second member 270*b* is further decelerated due to the contact, and falls downward. Part of the developer that has come into contact with the second member 270*b* comes into contact with the developer that has fallen downward after coming into contact with the first member 270*a*. The developer that has come into contact with the second member 270*b* and then with the developer that has fallen downward after coming into contact with the first member 270*a* is decelerated due to the contact, and falls downward.

If the developer that has been separated from the developing sleeve 260 is scattered and reaches the second inlet 292, the developer flows into the second channel 290 together with the air that is discharged out of the container 202, and the second channel 290 becomes clogged with the developer. If the second channel 290 becomes clogged, the air in the container 202 is not discharged out of the container 202, and there is a risk that the developer will be discharged out of the container 202 through an opening other than the second channel 290.

According to the present exemplary embodiment, even when the developer that has been separated from the developing sleeve 260 flows rearward beyond the developing sleeve 260 when viewed from the photoconductor 102, the developer is decelerated and falls downward, so that the developer does not reach the second inlet 292. Therefore, the developer does not enter the second inlet 292. Since the developer does not enter the second inlet 292 and clogging of the second channel 290 does not occur, the pressure in the container 202 does not increase, and the developer does not flow out of the container 202 through an opening other than the second channel 290.

MODIFICATIONS

Although an exemplary embodiment of the present invention has been described, the present invention is not limited to the above-described exemplary embodiment, and various other exemplary embodiments are possible. For example, the present invention may be implemented so that the above-described exemplary embodiment is modified as described below. The above-described exemplary embodiment and the modifications described below may be applied in combination.

First Modification

Figure 5:
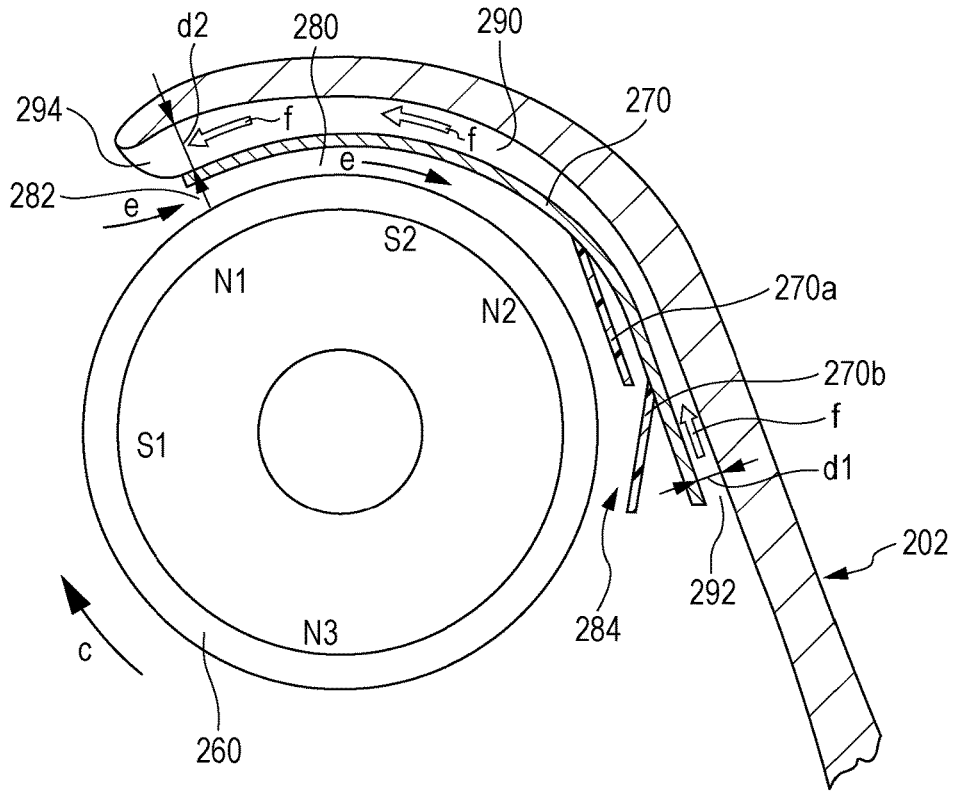
FIG. 5 illustrates a modification in which the angle of a second member is changed.

In the above-described exemplary embodiment, the second member 270*b* is arranged such that the angle θ2 between the vertical line L2 and the second member 270*b* is positive. However, as illustrated in FIG. 5, the second member 270*b* may instead be inclined toward the developing sleeve 260 relative to the vertical line L2 so that the angle θ2 is negative. Alternatively, the first member 270*a* and the second member 270*b* may be arranged such that the angles θ1 and θ2 are both positive and satisfy the relationship θ1<θ2. Alternatively, the first member 270*a* and the second member 270*b* may be arranged such that the angles θ1 and θ2 are both negative and satisfy the relationship θ1<θ2.

Alternatively, the first member 270*a* and the second member 270*b* may be arranged such that the angles θ1 and θ2 are equal to each other. The first member 270*a* and the second member 270*b* may be arranged such that the angles θ1 and θ2 are 0 degrees.

Second Modification

Figure 6:
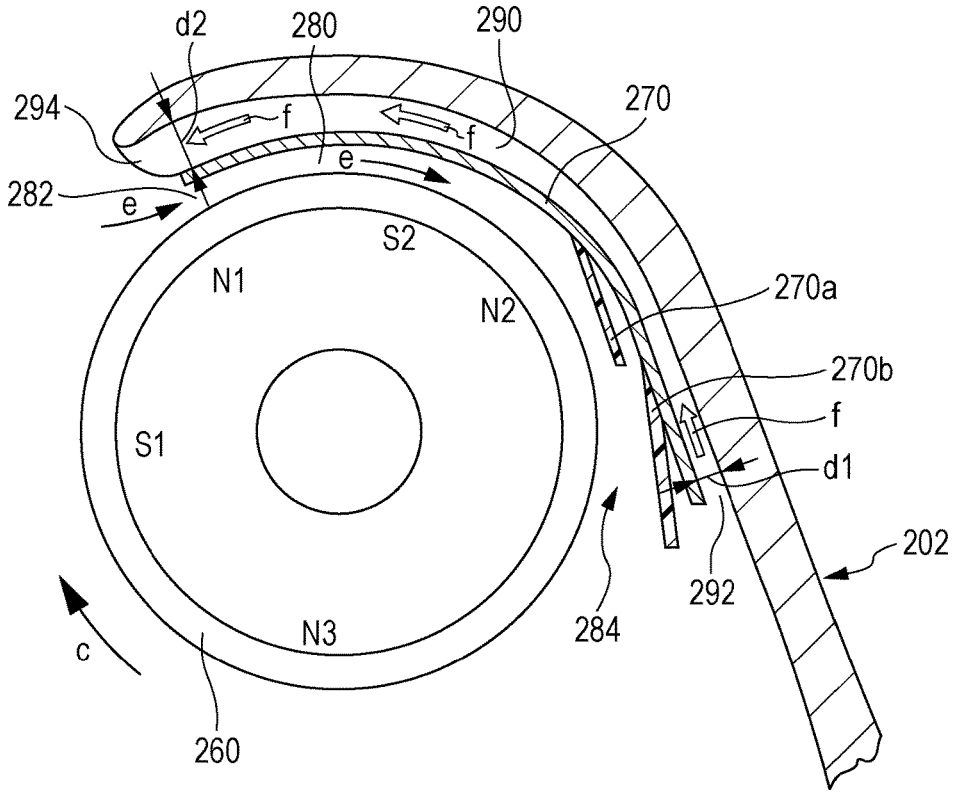
FIG. 6 illustrates a modification in which the length of the second member is changed.

In an exemplary embodiment of the present invention, as illustrated in FIG. 6, the second member 270*b* may be arranged such that the bottom end thereof is below the bottom end of the channel defining member 270. According to this structure, the developer that has been separated from the developing sleeve 260 does not easily enter the second inlet 292.

Third Modification

Figure 7:
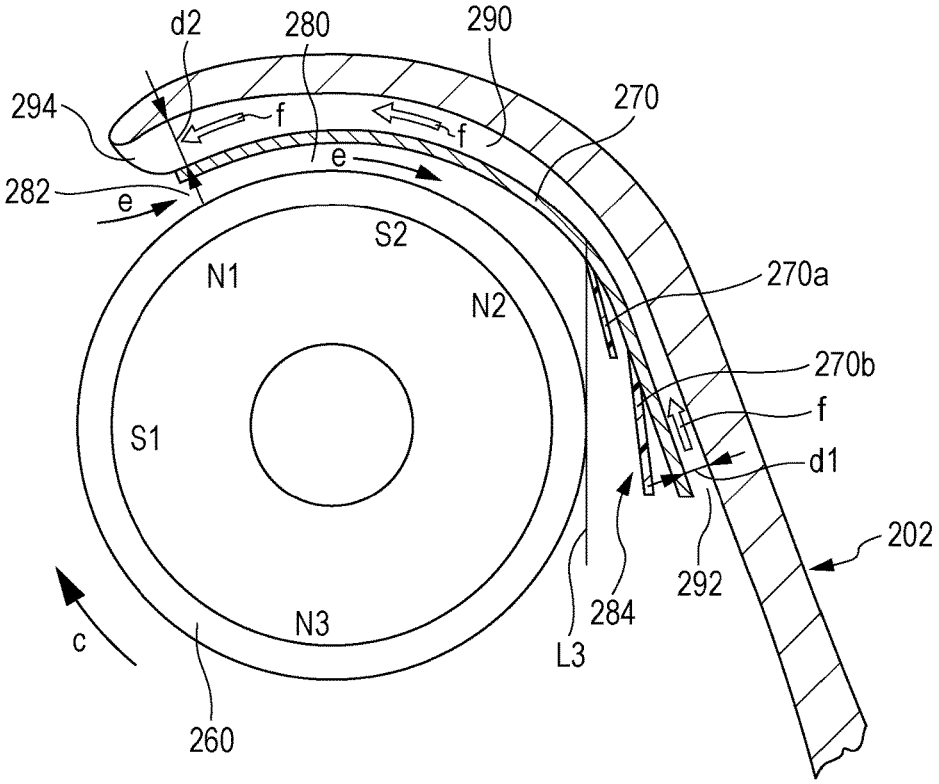
FIG. 7 illustrates a modification in which the positions of a first member and the second member are changed.

In an exemplary embodiment of the present invention, as illustrated in FIG. 7, the first member 270*a* and the second member 270*b* may be positioned behind a tangent line L3 at the intersection between a horizontal line that extends through the center of the developing sleeve 260 and the outer peripheral surface of the developing sleeve 260 when viewed from the photoconductor 102. In this case, the developer that has come into contact with the first member 270*a* and the second member 270*b* does not easily return to the developing sleeve 260 while the developer falls downward.

Fourth Modification

In an exemplary embodiment of the present invention, the bottom end of the first member 270*a* may be positioned below the top end of the second member 270*b* in the vertical direction.

Fifth Modification

Figure 8:
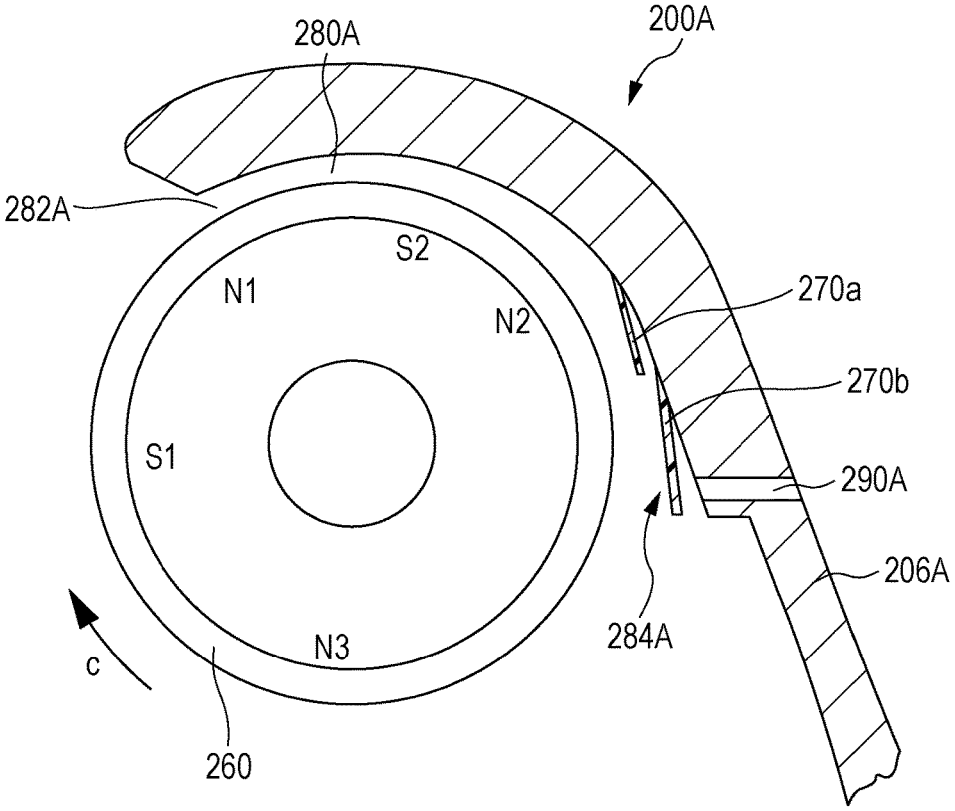
FIG. 8 illustrates a modification of a channel that connects the inside of a container to the outside of the container.

The channel for discharging the air in the container 202 to the outside of the container 202 is not limited to the second channel 290 according to the exemplary embodiment. FIG. 8 illustrates a modification of the channel for discharging the air in the container 202 to the outside of the container 202.

A developing device 200A according to this modification includes a container upper portion 206A instead of the container upper portion 206, and does not include the channel defining member 270. A first channel 280A is defined between the container upper portion 206A and the developing sleeve 260. The first channel 280A has a first inlet 282A that is disposed downstream of the region in which the developing sleeve 260 supplies the toner to the photoconductor 102 in the rotation direction of the developing sleeve 260, and a first outlet 284A that is disposed behind the developing sleeve 260 when viewed from the photoconductor 102.

The first member 270*a* is disposed behind the magnetic pole N2 when viewed from the photoconductor 102, and projects from a surface of the container upper portion 206A that faces the developing sleeve 260. The second member 270*b* is disposed behind the magnetic pole N2 and behind the first member 270*a* when viewed from the photoconductor 102, and projects from the surface of the container upper portion 206A that faces the developing sleeve 260.

A second channel 290A connects the space inside the container 202 to the space outside the container 202. The second channel 290A is disposed behind the second member 270*b* when viewed from the photoconductor 102, and the bottom end of the second channel 290A is above the bottom end of the second member 270*b* in the vertical direction. Since the second channel 290A connects the space inside the container 202 to the space outside the container 202, the high-pressure air in the container 202 flows into the second channel 290A, and is discharged to the outside where the pressure is lower than that in the container 202. Accordingly, the pressure increase in the container 202 is reduced.

In this modification, the developer that has been separated from the developing sleeve 260 flows rearward beyond the developing sleeve 260 when viewed from the photoconductor 102. Part of the developer comes into contact with the first member 270*a*, and another part of the developer comes into contact with the second member 270*b*. Similar to the exemplary embodiment, the developer comes into contact with the first member 270*a* and the second member 270*b* and falls downward. Therefore, the developer does not easily flow into the second channel 290A, which is above the bottom end of the second member 270*b*. In this modification, the second channel 290A may be provided with a filter that collects the developer.

Sixth Modification

In an exemplary embodiment of the present invention, the channel defining member 270, the first member 270*a*, and the second member 270*b* may be formed integrally with each other.

Seventh Modification

In an exemplary embodiment of the present invention, the material of each of the first member 270*a* and the second member 270*b* may be the same as or different from the material of the channel defining member 270.

In addition, in an exemplary embodiment of the present invention, the material of the first member 270*a* may be the same as or different from the material of the second member 270*b*.

When the first member 270*a* and the second member 270*b* are made of different materials, the material of the first member 270*a* may be softer than the material of the second member 270*b*.

Eighth Modification

In the above-described exemplary embodiment of the present invention, the first member 270*a* and the second member 270*b* are plate-shaped members. However, the first member 270*a* may instead be a film-shaped or sheet-shaped member that is deformed when the developer comes into contact therewith, and the second member 270*b* may be a plate-shaped member that is not deformed when the developer comes into contact therewith.

Ninth Modification

In a color image forming apparatus including plural developing units for toners of respective colors, the structures described in the foregoing exemplary embodiment and modifications may be applied to each of the developing units of the respective colors.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a container that contains developer;

a rotating body that rotates while carrying the developer and supplies the developer to a latent image formed on an image carrier;

a channel through which air in the container is discharged out of the container;

a first member that is positioned downstream of a position at which the developer is separated from the rotating body in a rotation direction of the rotating body and with which the developer separated from the rotating body comes into contact; and a second member that is positioned downstream of the first member in the rotation direction of the rotating body and with which the developer separated from the rotating body comes into contact.

2. A developing device comprising:

a container that contains developer;

a rotating body that rotates while carrying the developer and supplies the developer to a latent image formed on an image carrier;

a channel through which air in the container is discharged out of the container;

a first member that changes a direction in which the developer separated from the rotating body moves; and a second member that is positioned downstream of the first member in a rotation direction of the rotating body and changes the direction in which the developer separated from the rotating body moves.

3. The developing device according to claim 1, wherein a first angle between a vertical line and the first member differs from a second angle between a vertical line and the second member.

4. The developing device according to claim 2, wherein a first angle between a vertical line and the first member differs from a second angle between a vertical line and the second member.

5. The developing device according to claim 3, wherein the first angle is greater than the second angle.

6. The developing device according to claim 4, wherein the first angle is greater than the second angle.

7. The developing device according to claim 3, wherein the second member is inclined toward the rotating body.

8. The developing device according to claim 4, wherein the second member is inclined toward the rotating body.

9. The developing device according to claim 1, wherein the channel has an inlet that is positioned behind the rotating body when viewed from the image carrier.

10. The developing device according to claim 2, wherein the channel has an inlet that is positioned behind the rotating body when viewed from the image carrier.

11. The developing device according to claim 9, wherein the second member is positioned between the position at which the developer is separated from the rotating body and the inlet.

12. The developing device according to claim 10, wherein the second member is positioned between the position at which the developer is separated from the rotating body and the inlet.

13. The developing device according to claim 11, wherein the first member is positioned between the position at which the developer is separated from the rotating body and the second member.

14. The developing device according to claim 12, wherein the first member is positioned between the position at which the developer is separated from the rotating body and the second member.

15. The developing device according to claim 1, further comprising:

a channel defining portion disposed between the container and the rotating body in a region downstream of a position at which the rotating body supplies the developer to the image carrier in the rotation direction of the rotating body, the channel defining portion defining the channel and a channel through which air outside the container flows into the container.

16. The developing device according to claim 2, further comprising:

a channel defining portion disposed between the container and the rotating body in a region downstream of a position at which the rotating body supplies the developer to the image carrier in the rotation direction of the rotating body, the channel defining portion defining the channel and a channel through which air outside the container flows into the container.

17. The developing device according to claim 1, further comprising:

a filter that is provided on the channel through which the air in the container is discharged out of the container, the filter collecting the developer.

18. The developing device according to claim 1, wherein the first member and the second member are made of different materials.

19. The developing device according to claim 1, wherein the first member is deformed when the developer comes into contact with the first member, and the second member is not deformed when the developer comes into contact with the second member.

20. An image forming apparatus comprising:

a developing device including a container that contains developer, a rotating body that rotates while carrying the developer and supplies the developer to a latent image formed on an image carrier, a channel through which air in the container is discharged out of the container, a first member that is positioned downstream of a position at which the developer is separated from the rotating body in a rotation direction of the rotating body and with which the developer separated from the rotating body comes into contact, and a second member that is positioned downstream of the first member in the rotation direction of the rotating body and with which the developer separated from the rotating body comes into contact; and the image carrier that carries an image.

* * * * *